US006247439B1

(12) United States Patent
Gokan et al.

(10) Patent No.: US 6,247,439 B1
(45) Date of Patent: Jun. 19, 2001

(54) STARTER FOR INTERNAL COMBUSTION ENGINE

(75) Inventors: Yoshitsugu Gokan; Kazumitsu Yamamoto; Nobuaki Inumaru; Tatsuro Kimura, all of Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/418,576

(22) Filed: Oct. 15, 1999

(30) Foreign Application Priority Data

Oct. 16, 1998 (JP) ..... 10-295860

(51) Int. Cl.[7] ..... F02N 3/04; B21K 1/30

(52) U.S. Cl. ..... 123/185.6; 123/185.8; 74/7 C; 74/7 E; 74/411; 29/893.1; 29/893.2

(58) Field of Search ..... 123/185.5, 185.6, 123/185.8; 74/6, 7 C, 7 E, 411, 412 TA, 414; 29/893.1, 893.2

(56) References Cited

U.S. PATENT DOCUMENTS 2,841,989 * 7/1958 Kreidler et al. ..... 123/185.5

FOREIGN PATENT DOCUMENTS 63-16863 5/1988 (JP) .
4-16649 3/1992 (JP) .

* cited by examiner

*Primary Examiner*—Andrew M. Dolinar
(74) *Attorney, Agent, or Firm*—Birch, Stewart, Kolasch & Birch, LLP

(57) ABSTRACT

To provide a starter for an internal combustion engine which is capable of reducing a press-fit amount of a press-fit portion of a torque absorbing mechanism of a rotation transmitting means for transmitting the rotation of a kick shaft to a crank shaft, thereby enhancing the durability of the starter and making the starter compact. A kick-type starter for an internal combustion engine includes a rotation transmitting mechanism (a kick drive gear, a boss having a ratchet portion, a pinion gear, and an idler gear) for transmitting the rotation of a kick shaft to a crank shaft. The rotation transmitting mechanism is provided with a torque absorbing mechanism for absorbing an excessive torque due to an excessive input from the kick shaft. The torque absorbing mechanism is provided on the kick shaft, and includes a gear set composed of the boss having the ratchet and the pinion gear which are press-fitted to each other. At least one of the press-fit surface of the boss having the ratchet and the press-fit plane of the pinion gear is subjected to a low temperature sulphurizing treatment.

18 Claims, 2 Drawing Sheets

STARTER FOR INTERNAL COMBUSTION ENGINE

BACKGROUND OF THE INVENTION

1. Field of the Invention

The present invention relates to a starter for an internal combustion engine, and more particularly to a starter for an internal combustion engine, in which a rotation transmitting mechanism for transmitting the rotation of an input portion to a crank shaft is provided with a torque absorbing mechanism.

2. Description of Background Art

A kick type starter of an internal combustion engine mounted on a motorcycle is configured such that an actuated force of a kick pedal is converted into a kick shaft rotating force by a kick pedal shaft and the rotation of the kick shaft is transmitted to a crank shaft via a rotation transmitting mechanism. The rotation transmitting mechanism is composed of a kick drive gear, ratchet portion formed on a pinion gear, a pinion gear, gear train connected to a counter shaft and a main shaft of a transmission, and a primary reduction drive gear connected to the crank shaft.

Since the crank shaft is in a stopped state when the kick pedal is actuated, a large torque is applied to the gears of the rotation transmitting mechanism. Because of not only the excessively increased torque due to actuation of the kick pedal but also the occurrence of a compressive reaction upon upward movement of a piston during the kick operation or abnormality of an ignition timing, an excessive torque may be applied to the gears of the rotation transmitting mechanism during the starting operation. In the prior art rotation transmitting mechanism, the size and strength of each gear have been set in consideration of the above-described excessive torque applied to the gear.

A starter for starting an engine of a motorcycle, including a damper device for absorbing an excessive torque caused upon starting the engine, has been disclosed in Japanese Utility Model Publication No. Sho 63-16863. The starter is of a type using a starter motor, in which the rotation of the starter motor is transmitted to a crank shaft from a reduction gear through a starter, driven gear, characterized in that damper springs are contracted between a clutch outer and a clutch inner of an over-running clutch for absorbing an excessive torque caused upon starting the engine, on the other hand, a technique concerned with a drive shaft of a motorcycle and a gear press-fitted around the drive shaft has been disclosed, in Japanese Patent Publication No., Hei 4-16649. In this technique, one of contact surfaces (press-fit surfaces) of the drive shaft and the gear is subjected to a low temperature sulphurizing treatment for suitably setting a slip generating torque between both the members, thereby damping a reaction force from a tread or the like caused upon power transmission.

The starter described in Japanese Utility Model Publication No. Sho 63-16863, however, has a problem that since a plurality of the springs must be disposed between a plurality of projecting pieces of the clutch outer and a plurality of projecting pieces of the clutch inner in an annular shape as a whole, the structure of the damper is complicated and the size thereof is enlarged.

The technique described in Japanese Patent Publication No. Hei 4-16649 also has a problem. Since the driver shaft has a relatively small diameter for the portion subjected to the low temperature sulphurizing treatment being one of the press-fit surfaces of the driver shaft and the gear, a press-fit amount must be enlarged for obtaining a desired slip generating torque from the press-fitted portions of the drive shaft and the gear, with a result that the press-fitted portions tend to be made longer.

An object of the present invention is to provide a starter for an internal combustion engine, which is excellent in durability and has a compact structure, characterized in that a desired slip generating torque can be set with a small press-fit amount.

According to the present invention, there is provided a starter for an internal combustion engine including a rotation transmitting mechanism for transmitting the rotation of an input portion to a crank shaft, wherein the rotation transmitting mechanism is provided with a torque absorbing mechanism for absorbing an excessive torque caused by an excessive input from the input portion or a reversed input from the crank shaft, the starter being characterized in that the torque absorbing mechanism is provided on a supporting shaft and includes a gear set composed of an input gear and an output gear which are press-fitted to each other; and at least one of a press-fit surface of the input gear and a press-fit surface of the output gear is subjected to a low temperature sulphurizing treatment.

In accordance with the present invention, since at least one of the press-fit surfaces of the gear set is subjected to the low temperature sulphurizing treatment, the press-fit surfaces have a low friction coefficient and a good wear resistance. As a result, it is possible to obtain the starter including the rotation transmitting mechanism having the torque absorbing mechanism capable of stably keeping a slip generating torque for a long-period of time. Also, since the torque absorbing mechanism is configured by the gear set composed of the gears press-fitted to each other, the starter is made compact. This is advantageous in terms of layout of the starter. Further, since at least one of the press-fit surfaces of the input and output gears each of which has a diameter larger than that of the supporting shaft is subjected to the temperature sulphurizing treatment, a fastening force for setting a desired slip generating torque can be set at a value smaller than a fastening force obtained by press-fitting in the case where the torque absorbing mechanism is composed of the supporting shaft and a gear which is press-fitted around the supporting shaft. In other words, the press-fit amount in the case where the input and output gears, each of which has a diameter larger than that of the supporting shaft, are press-fitted to each other, maybe smaller than the press-fit amount in the case where the gear is press-fitted around the supporting shaft.

According to the present invention, because of the fact that the fastening force is small in addition to the fact that the press-fit surface is subjected to the low temperature sulphurizing treatment, the wear of the press-fit surface can be further reduced. This makes it possible to obtain the starter including the rotation transmitting mechanism having the torque absorbing mechanism which is further enhanced in durability.

According to the present invention, the above supporting shaft is a kick shaft. With this configuration, it is possible to obtain the kick-type starter capable of absorbing an excessive torque caused upon kick operation with a compact structure.

According to the present invention, the above supporting shaft is an idler shaft. With this configuration, since a rotatable gear set can be provided on an arbitrary shaft constituting part of the rotation transmitting mechanism, it is possible to increase the degree of freedom in design.

According to the present invention, one of the input gear and the output gear is press-fitted to a boss of the other of the input gear and the output gear, the other gear being different from the supporting shaft.

With this configuration, it is possible to broaden the ranges of selection of material characteristics such as the kinds of materials of the supporting shaft, the input gear, and the output gear.

According to the present invention, the above press-fitting is based on elastic deformation within an elastic limit. With this configuration, it is easy to set the fastening force at the press-fitted portion, and thereby the slip generating torque caused by press-fitting of the input gear and the output gear to each other.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
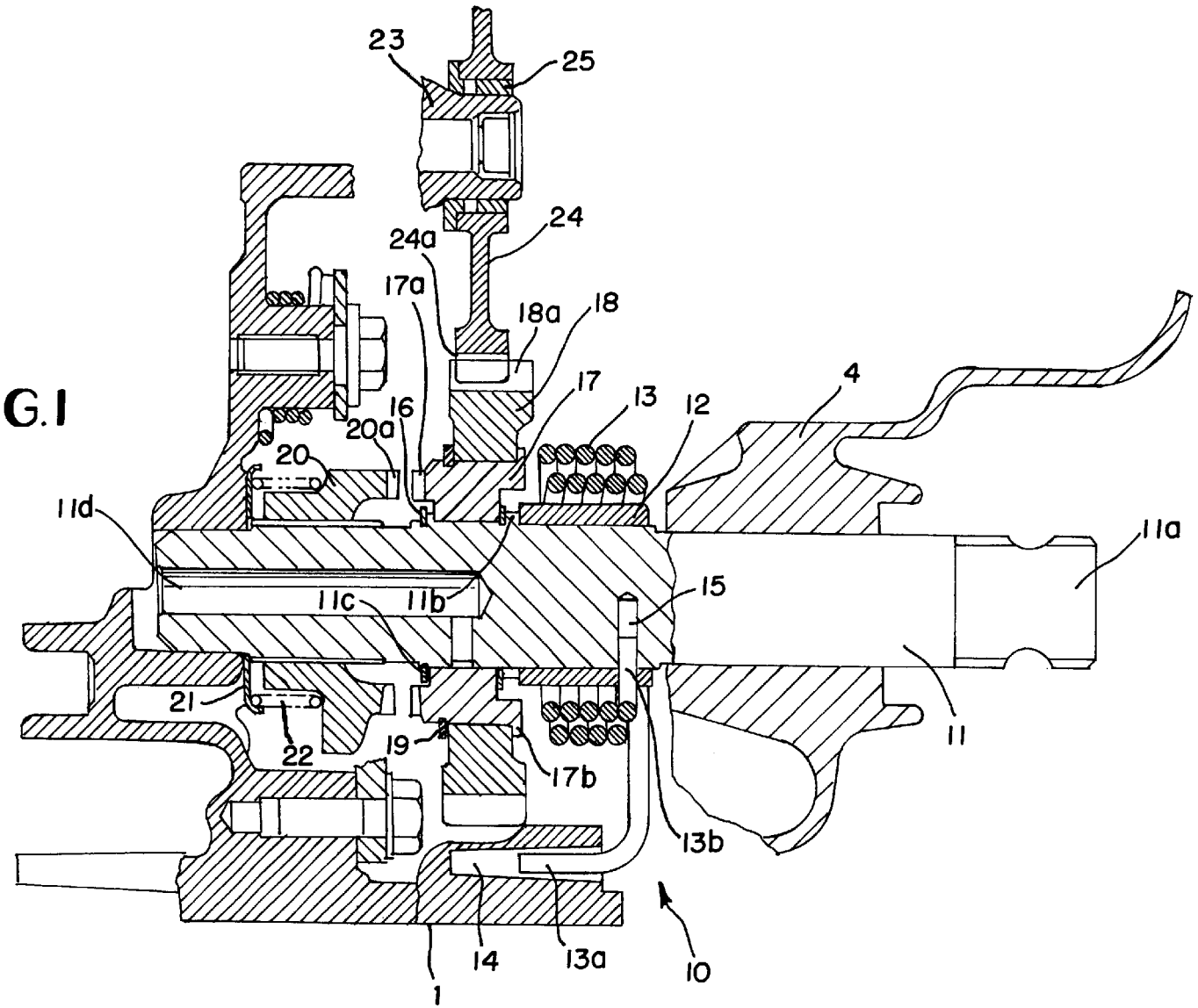
FIG. 1 is a vertical sectional view of a kick-type starter for an internal combustion engine according to a first embodiment of the present invention.

Hereinafter, a first embodiment of the present invention will be described with reference to FIG. 1. A single-cylinder/four-stroke-cycle internal combustion engine (not shown), which is started by a kick-type starter 10 according to the first embodiment, is mounted on a motorcycle (not shown) with its crank shaft extending in the width direction of a vehicle. A crank case of the internal combustion engine is divided into right and left parts with respect to the longitudinal center plane of the vehicle (only the right crank case 1 is shown), and a multi-stage gear transmission and a multi-disk friction clutch are integrally assembled in the crank case.

According to this embodiment, a kick shaft 11 of the kick-type starter 10 is equivalent to an input portion. The kick shaft 11 is rotatably supported by the right crank case 1 and a right crank case cover 4 positioning on the left side of the right crank case 1. A kick pedal shaft including a kick pedal (both not shown) is removably mounted on a right end portion 11*a* of the kick shaft 11 projecting rightwardly from the right crank case cover 4. A sleeve 12 is fitted around the outer periphery of a portion of the kick shaft 11 near the right crank case cover 4 in such a manner as to be in contact with the right end surface of a flange 11*b* formed on the kick shaft 11. A return coil spring 13 is disposed outside the sleeve 12 with a gap kept therebetween. The sleeve 12 prevents falling-down of the return coil spring 13.

One end 13*a* of the return coil spring 13 is inserted in an engagement hole 14 formed in the right crank case 1, and the other end 13*b* of the return coil spring 13 passes through the sleeve 12 and is locked in a locking hole 15 formed in the kick shaft 11.

A boss 17 is rotatably inserted around a portion, located leftwardly from the sleeve 12, of the kick shaft 11. The right side of the boss 17 is locked by the left end surface of the flange 11*b*, and the left side portion of the boss 17 is locked by a circlip 16. The circlip 16 is engaged in a peripheral groove 11*c* formed in the kick shaft 11. The boss 17 thus locked by the flange 11*b* and the circlip 16 is immovable in the axial direction. An oil passage lid is formed in the kick shaft 11. The contact portions of the boss 17 and the kick shaft 11 are lubricated by oil supplied from the left opening end of the oil passage lid.

A pinion gear 18 having a toothed portion 18*a* is press-fitted around the outer periphery of the boss 17. To be more specific, the center hole of the pinion gear 18 has a diameter being nearly equal to or slightly larger than the outside diameter of the boss 17; at least one of the outer peripheral surface of the boss 17 and the inner peripheral surface of the pinion gear 18, which constitute the press-fitted portions of the boss 17 and the pinion gear 18, is subjected to a low temperature sulphurizing treatment, to be formed with a low temperature sulphurizing treatment film; and the boss 17 is press-fitted in the center hole of the pinion gear 18. It should be noted that the pinion gear 18 is immovable in the axial direction by a flange 17*b* integrally formed on the boss 17 and a circlip 19.

The low temperature sulphurizing treatment is well known as a surface treatment capable of giving a good wear resistance to the surface of a ferrous material (an iron-based material). With respect to the surface of the material having been subjected to this treatment, not only the friction coefficient is reduced, but also the fatigue strength is increased and thereby the wear resistance is improved.

One example of the low temperature sulphurizing treatment will be described below. The low temperature sulphurizing treatment is performed by a manner of masking a portion of a workpiece (for example, made from a ferrous material) not required to be formed with a low temperature sulphurizing treatment film; dipping the workpiece in a solution of an alkali metal salt containing sulfur kept at a temperature ranging from 185° C. to 195° C., connecting a plus electrode to the workpiece and a minus electrode to a bath, and subjecting the solution to anodic electrolysis for a specific time, to form a diffusion layer (thickness: for example, about 7 $\mu$m) of a sulfide (for example, iron sulfide) on the surface of the workpiece. The sulfide (for example, iron sulfide) not only has a good lubricating property, but also a good durability because of diffusion thereof in the base material to thereby improve the wear resistance of the surface of the workpiece.

On the other hand, the press-fitted portions are set to cause a slip therebetween when an excessive torque is applied to the boss 17 or the pinion gear 18, and therefore, they constitute a torque absorbing mechanism for absorbing such an excessive torque. The value of the torque allowed to generate a slip (slip generating torque) can be set by suitably selecting the press-fit amount between the boss 17 and the pinion gear 18 in consideration of the strength of the gear set. Incidentally, according to this embodiment, the pinion gear 18 is press-fitted around the outer peripheral surface of the boss 17 having a diameter larger than the outside diameter of the kick shaft 11 as the supporting shaft for supporting the boss 17 and the pinion gear 18, and accordingly, to give a fastening force for setting a desired slip generating torque, the press-fit amount required in this embodiment may be smaller than that required for a torque absorbing mechanism configured by press-fitting the pinion gear 18 around the kick shaft 11. To be more specific, the press-fitting of the pinion gear 18 around the boss 17 can be performed on the basis of elastic deformation of each of the boss 17 and the pinion gear 18 within the elastic limit thereof.

The left end surface of the boss 17 is provided with a ratchet portion 17*a* which is adapted to transmit only the rotation in the normal rotational direction of the kick shaft caused by actuation of the kick pedal, but not to transmit the rotation in the reversed direction to the above normal rotational direction of the kick shaft 11.

Here, the boss 17 having the ratchet 17*a* and the pinion gear 18 constitute a set of gears press-fitted to each other on the kick shaft 11, and simultaneously, as will be described later, they function as an input gear and an output gear with respect to transmission of the rotation of the kick shaft 11.

A kick drive gear 20, positioned leftwardly from the boss 17, having a toothed portion 20*a* facing to the ratchet portion 17*a* is spline-connected via an inclined groove or spiral groove formed in the outer periphery of the kick shaft 11. When the kick shaft 11 is rotated, the kick drive gear 20 is moved in the axial direction of the kick shaft 11, so that the toothed portion 20*a* is meshed with the ratchet portion 17*a*. A damping coil spring 22 is provided between the kick drive gear 20 and a spring seat 21 which is fitted around the kick shaft 11 and is supported by the right crank case 1. When the kick drive gear 20 is released from meshing with the ratchet portion 17*a* and is returned to the original position, the return speed of the kick drive gear 20 in the axial direction is decelerated by the damping coil spring 22.

An idler shaft 23 is mounted to the crank case, and an idler gear 24 having a toothed portion 24*a* meshed with the toothed portion 18*a* of the pinion gear 18 is rotatably mounted on the idler shaft 23 via a bearing 25.

The rotation of the idler gear 24 is transmitted to the crank shaft via a gear train (not shown).

Accordingly, in the first embodiment, the gear trains from the kick drive gear 20 provided on the kick shaft 11 equivalent to the input portion to a gear provided on the crank shaft constitute a rotation transmission mechanism of the kick-type starter 10.

The operation of the kick-type starter having the above configuration will be described below.

When a rotational force is applied to the kick shaft 11 by actuation of the kick pedal, the kick shaft 11 is rotated against the return force of the return coil spring 13, and thereby the kick drive gear 20 spline-connected to the kick shaft 11 is moved in the axial direction of the kick shaft 11, with a result that the toothed portion 20*a* of the kick drive gear 20 is meshed with the ratchet portion 17*a* of the boss 17. With such meshing, the rotation of the kick shaft 11 is transmitted to the boss 17 which is rotatably fitted around the kick shaft 11. At this time, since a torque that is generated and caused by the rotation is generally smaller than the slip generating torque set for the press-fitted portions, the bass 17 and the pinion gear 18 press-fitted around the boss 17 are integrally rotated. The rotation of the pinion gear 18 is transmitted to the idler gear 24 rotatably held by the idler shaft 23 via the toothed portion 24*a* meshed with the toothed portion 18*a* of the pinion gear 18. Accordingly, with respect to transmission of the rotation of the kick shaft 11, the boss 17 having the ratchet portion 17*a* and the pinion gear 18, which constitute the gear set, are taken as an input gear and an output gear, respectively.

In this way, the rotation of the kick shaft 11 is transmitted to the idler gear 24, and the rotation of the idler gear 24 is finally transmitted to the crank shaft via the gear train (not shown), and thereby the crank shaft is rotated.

If the kick pedal is forcibly actuated, for example, and thereby an excessive torque over the slip generating torque set for the press-fitted portions of the boss 17 and the pinion gear 18 is applied to the gear trains which constitute the rotation transmitting mechanism extending from the kick shaft 11 to the crank shaft, a slip occurs at the press-fitted portions, so that the excessive torque is absorbed by the press-fitted portions.

The effects of the first embodiment will be described below. When an excessive torque is applied to the gear trains of the rotation transmitting mechanism upon starting of the internal combustion engine, a slip occurs at the press-fitted portions at least one of which is subjected to the low temperature sulphurizing treatment, so that the excessive torque can be absorbed by the press-fitted portions. As a result, it is not required to excessively enhance the strength of each gear of the rotation transmitting mechanism. Further, since at least one of the press-fitted portions is subjected to the low temperature sulphurizing treatment, the press-fitted surface has a small friction coefficient and a good wear resistance as described above, so that the slip force at the press-fitted portions can be stably kept for a long-period of time. This makes it possible to keep the slip generating torque set on the basis of the a suitable press-fit amount for a long-period of time, and hence to easily control the torque.

Since the torque absorbing mechanism is configured by the gear set composed of gears press-fitted to each other, it is possible to make the starter compact. This is advantageous in terms of layout of the starter. The torque absorbing mechanism provided on the kick shaft 11 also makes it possible to reduce the influence of an excessive torque caused by the reversed rotation of the crank shaft exerted on the driver. Since the boss 17 around which the pinion gear 18 is press-fitted is a different member from that of the kick shaft 11, it is possible to broaden the range of selection of material characteristics such as the kinds of materials of the kick shaft 11, the boss 17, and the pinion gear 18.

Unlike the prior art method, according to this embodiment, the low temperature sulphurizing treatment is not applied to the outer peripheral surface of the kick shaft having a relatively small diameter, but is applied to the outer peripheral surface of the boss 17 having a diameter larger than that of the kick shaft or the inner peripheral surface of the pinion gear 18 to be press-fitted around the outer peripheral surface of the boss 17, and then the inner peripheral surface of the pinion gear 18 is press-fitted around the outer peripheral surface of the boss 17. As a result, a fastening force for setting a desired slip generating torque can be set at a value smaller than a fastening force obtained, for example, in the case where the pinion gear is press-fitted around the kick shaft. In other words, the press-fit amount required in the case where the pinion gear is press-fitted around the boss may be smaller than the press-fit amount required in the case where the torque absorbing mechanism is configured by press-fitting the pinion gear around the kick shaft. In this way, because of the fact that the fastening force is small in addition to the fact that the press-fit surface is subjected to the low temperature sulphurizing treatment, the wear of the press-fit surface can be further reduced. This makes it possible to obtain the kick-type starter including the rotation transmitting mechanism having the torque absorbing mechanism which is further enhanced in durability. Further, as described above, since the press-fitting of the boss 17 and the pinion gear 18 to each other can be performed on the basis of elastic deformation of each of the boss 17 and the pinion gear 18 within the elastic limit thereof, it is easy to set the fastening force and thereby the slip generating torque at the press-fitted portions.

Figure 2:
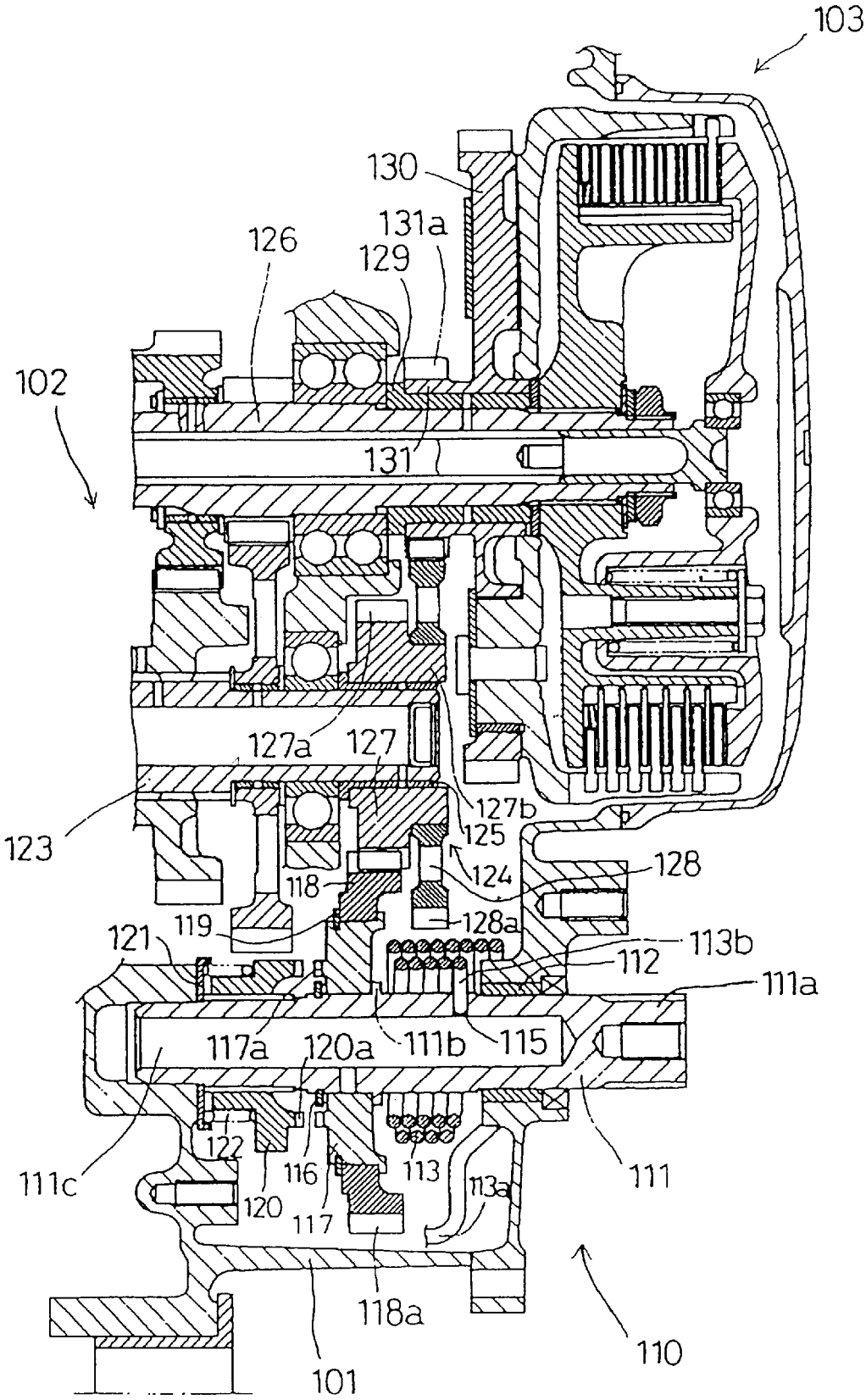
FIG. 2 is a vertical sectional view of a kick-type starter for an internal combustion engine according to a second embodiment of the present invention.

Next, a second embodiment of the present invention will be described with reference to FIG. 2. An internal combustion engine, which is started by a kick-type starter according to the second embodiment, is mounted on a motorcycle (not shown) with its crank shaft extending in the width direction of the vehicle. A crank case of the internal combustion engine is divided into right and left parts with respect to the longitudinal center plane of the vehicle (only the right crank case 101 is shown), and a multi-stage gear transmission 102 and a multi-disk friction clutch 103 are integrally assembled in the crank case.

According to the second embodiment, a kick shaft 111 of a kick-type starter 110 is equivalent to an input shaft. The kick shaft 111 is rotatably supported at two positions by the right crank case 101. A kick pedal shaft including a kick pedal (both not shown) is removably mounted to a right end portion 111*a* of the kick shaft 111 projecting rightwardly from the right crank case 101. In FIG. 2, a bearing 112 is illustrated. A return coil spring 113 is disposed on the left side of a right crank case 101, for supporting the right side of the kick shaft 111, in such a manner as to surround the outer periphery of the kick shaft 111 with a gap kept therebetween. One end 113*a* of the return coil spring 113 is engaged with the right crank case 101, and the other end 113*b* of the return coil spring 113 is locked in a locking hole 115 which is formed in the kick shaft 111 in such a manner as to extend up to an oil passage 111*c* formed in the kick shaft 111. A boss 117 is rotatably inserted around a portion, located leftwardly from the return coil spring 113, of the kick shaft 111. The right side portion of the boss 117 is locked by the left end surface of a flange 111*b* and the left side portion of the boss 117 is locked by a circlip 116 engaged in a peripheral groove formed in the kick shaft 111. The boss 117 thus locked by the flange 111*b* and the circlip 116 is immovable in the axial direction. The oil passage 111*c* is formed in the kick shaft 111, so that the contact portions of the boss 117 and the kick shaft 111 are lubricated by oil supplied from the left opening portion of the oil passage 111*c*.

A pinion gear 118 having a toothed portion 118*a* is press-fitted around the outer periphery of the boss 117. To be more specific, the center hole of the pinion gear 118 has a diameter being nearly equal to or slightly larger than the outside diameter of the boss 117; at least one of the outer peripheral surface of the boss 117 and the inner peripheral surface of the pinion gear 118, which constitute the press-fitted portions of the boss 117 and the pinion gear 118, is subjected to a low temperature sulphurizing treatment, to be formed with a low temperature sulphurizing treatment film; and the boss 117 is press-fitted in the center hole of the pinion gear 118. It should be noted that the pinion gear 118 is immovable in the axial direction by a flange 117*b* integrally formed on the boss 117 and a circlip 119.

The low temperature sulphurizing treatment is performed in the same manner as that described in the first embodiment. Like the first embodiment, the first press-fitted portions are set to cause a slip therebetween when an excessive torque is applied to the boss 117 or the pinion gear 118, and therefore, they constitute a torque absorbing mechanism capable of absorbing such an excessive torque. The value of the slip generating torque can be set by suitably selecting the press-fit amount between the boss 117 and the pinion gear 118 in consideration of the strength of the gear set. Incidentally, according to this embodiment, the pinion gear 118 is press-fitted around the outer peripheral surface of the boss 117 having a diameter larger than the outside diameter of the kick shaft 111 as the supporting shaft for supporting the boss 117 and the pinion gear 118, and accordingly, to give a fastening force for setting a desired slip generating torque, the press-fit amount required in this embodiment may be smaller than that required for a torque absorbing mechanism configured by press-fitting the pinion gear 118 around a small-diameter shaft, for example, the kick shaft 111. To be more specific, the press-fitting of the pinion gear 118 around the boss 117 can be performed on the basis of elastic deformation of each of the boss 117 and the pinion gear 118 within the elastic limit thereof The left end surface of the boss 117 is provided with a ratchet portion 117*a* which is adapted to transmit only the rotation in the normal rotational direction of the kick shaft caused by actuation of the kick pedal, but not to transmit the rotation in the reversed direction to the above normal rotational direction of the kick shaft 111. Here, the boss 117 having the ratchet 117*a* and the pinion gear 118 constitute a set of gears press-fitted to each other on the kick shaft 111, and simultaneously, as will be described later, they function as an input gear and an output gear with respect to transmission of the rotation of the kick shaft 111.

A kick drive gear 120 positioned leftwardly from the boss 117, having a toothed portion 120*a* facing to the ratchet portion 117*a* is spline-connected around the outer periphery of the kick shaft 111 via an inclined groove or spiral groove formed in the outer periphery of the kick shaft 111. When the kick shaft ill is rotated, the kick drive gear 120 is moved in the axial direction of the kick shaft 111, so that the toothed portion 120*a* is meshed with the ratchet portion 117*a*. A damping coil spring 122 is provided between the kick drive gear 120 and a spring seat 121 which is fitted around the kick shaft 111 and is supported by the right crank case 101. When the kick drive gear 120 is released from meshing with the ratchet portion 117*a* and is returned to the original position, the return speed of the kick drive gear 120 in the axial direction is decelerated by the damping coil spring 122.

An idler gear 124 for transmitting the rotation of the pinion gear 118 to a main shaft 126 of the multi-stage transmission 102 is rotatably mounted on a counter shaft 123 of the transmission 102. Accordingly, in this kick-type starter 110, the counter shaft 123 constitutes the idler shaft.

The idler gear 124 is composed of a first idler gear 127 and a second idler gear 128. The first idler gear 127 is rotatably mounted on the counter shaft 123 via a bearing 125. A toothed portion 127*a* meshed with the toothed portion 118*a* of the pinion gear 118 provided on the kick shaft 111 is formed on the left portion of the first idler gear 127, and a boss 127*b* is formed on the right portion of the first idler gear 127. The second idler gear 128 is press-fitted around the boss 127*b*. A toothed portion 128*a* of the second idler gear 128 is meshed with a toothed portion 131*a* of an auxiliary gear 131 integrally formed on a primary reduction driven gear 130 connected to a clutch housing of the multi-disk friction clutch 103.

The center hole of the second idler gear 128 has a diameter being nearly equal to or slightly larger than the outside diameter of the boss 127*b*; at least one of the outer peripheral surface of the boss 127*b* and the inner peripheral surface of the second idler gear 128, which constitute the second press-fitted portions of the boss 127*b* and the second idler gear 128, is subjected to the same low temperature sulphurizing treatment as that described in the first embodiment; and the boss 127*b* is press-fitted in the center hole of second idler gear 128.

The second press-fitted portions are set to cause a slip therebetween when an excessive torque is applied to the first idler gear 127 or the second idler gear 128, and therefore, they constitute a torque absorbing mechanism for absorbing such an excessive torque. Like the press-fitted portions described in the first embodiment, the value of the slip generating torque can be set by suitably selecting the press-fit amount between the boss 127*b* and the second idler gear 128 in consideration of the strength of the boss 127*b* and the second idler gear 128. Incidentally, according to this embodiment, the second idler gear 128 is press-fitted around the outer, peripheral surface of the boss 127*b* having a diameter larger than the outside diameter of the counter shaft 123 as the supporting shaft for supporting the first idler gear 127 and the second idler gear 128, and accordingly, to give a fastening force for setting a desired slip generating torque, the press-fit amount required in this embodiment may be smaller than that required for a torque absorbing mechanism configured by press-fitting the gear around a small-diameter shaft, for example, the counter shaft 123. To be more specific, the press-fitting of the second idler gear 128 around the boss 127*b* can be performed on the basis of elastic deformation of each of the boss 127*b* and the second idler gear 128 within the elastic limit thereof In the kick-type starter according to the second embodiment, the first idler gear 127 and the second idler gear 128 constitute a set of gears press-fitted to each other on the counter shaft 123, and simultaneously, as will be described later, they function as an input gear and an output gear with respect to transmission of the rotation of the kick shaft 111.

The rotation of the idler gear 124 is transmitted to the primary reduction driven gear 130 via the auxiliary gear 131. The rotation of the, primary reduction driven gear 130 is finally transmitted to the crank shaft via a primary reduction drive gear (not shown).

Accordingly, in the second embodiment, the gear trains from the kick drive gear 120 provided on the kick shaft 111 equivalent to the input portion to a gear provided on the crank shaft constitute a rotation transmission mechanism of the kick-type starter 110.

The operation of the kick-type starter having the above configuration will be described below.

When a rotational force is applied to the kick shaft 111 by actuation of the kick pedal, the kick shaft 111 is rotated against the return force of the return coil spring 113, and thereby the kick drive gear 120 spline-connected to the kick shaft 111 is moved in the axial direction of the kick shaft 111, with a result that the toothed portion 120*a* of the kick drive gear 120 is meshed with the ratchet portion 117*a* of the boss 117.

With such meshing, the rotation of the kick shaft 111 is transmitted to the boss 117 which is rotatably fitted around the kick shaft 111. At this time, since a torque generated caused by the rotation is generally smaller than the slip generating torque set for the first press-fitted portions, the boss 117 and the pinion gear 118 press-fitted around the boss 117 are integrally rotated. The rotation of the pinion gear 118 is transmitted to the first idler gear 127 rotatably held by the counter shaft 123 via the toothed portion 127*a* meshed with the toothed portion 118*a* of the pinion gear 118. At this time, since a torque generated caused by the rotation is generally smaller than the slip generating torque set for the second press-fitted portions, the boss 127*b* and the second idler gear 128 press-fitted around the boss 127*b* are integrally rotated. The rotation of the second idler gear 128 is transmitted to the auxiliary gear 131 rotatably held by the main shaft 126 via the toothed portion 131*a* meshed with the toothed portion 128*a*. With respect to the transmission of the rotation of the kick shaft 111, the boss 117 and the pinion gear 118, which constitute the gear set on the gear shaft 111, are taken as an input gear and an output gear, respectively, and the first idler gear 127 and the second idler gear 128, which constitute the gear set on the counter shaft 123 as the idler shaft, are taken as an input gear and an output gear, respectively.

Like the first embodiment, if an excessive torque over the slip generating torque set for the first press-fitted portions of the boss 117 and the pinion gear 118 or the second press-fitted portions of the first idler gear 127 and the second idler gear 128 is applied to the gears of the rotation transmitting mechanism extending from the kick shaft 111 to the crank shaft, a slip occurs at the first or second press-fitted portions, so that the excessive torque is absorbed by the first or second press-fitted portions.

The effects of the second embodiment will be described below.

Like the first embodiment, when an excessive torque is applied to the gear trains of the rotation transmitting mechanism upon the starting of the internal combustion engine, a slip occurs at the first or second press-fitted portions at least one of which is subjected to the low temperature sulphurizing treatment, so that the excessive torque can be absorbed by the first or second press-fitted portions. As a result, it is not required to excessively enhance the strength of each gear of the rotation transmitting mechanism. Further, since at least one of the press-fitted portions is subjected to the low temperature sulphurizing treatment, the slip force at the press-fitted portions can be stably kept for a long-period of time. This makes it possible to keep the slip generating torque set on the basis of the a suitable press-fit amount for a long-period of time, and hence to easily control the torque. Since the torque absorbing mechanism is configured by the gear set composed of gears press-fitted to each other, it is possible to make the starter compact. This is advantageous in terms of layout of the starter. The torque absorbing mechanism provided on the kick shaft 111 also makes it possible to reduce the influence of an excessive torque caused by the reversed rotation of the crank shaft exerted on the driver. Since the boss 117 around which the pinion gear. 118 is press-fitted is a different member from that of the kick shaft 111, it is possible to broaden the ranges of selection of material characteristics such as the kinds of materials of the kick shaft 111, the boss 117, and the pinion gear 118. Since the gear set can be simply provided on an arbitrary shaft constituting part of the rotation transmitting mechanism, for example, the idler gear, it is possible to increase the degree of freedom in design.

Unlike the prior art method, according to this embodiment, the low temperature sulphurizing treatment is not applied to the outer peripheral surface of the kick shaft or counter shaft having a relatively small diameter, but is applied to the outer peripheral surface of the boss having a diameter larger than that of the kick shaft or counter shaft or to the inner peripheral surface of the gear to be press-fitted around the outer peripheral surface of the boss, and further the first or second press-fitted portions are provided at the outer periphery of the boss having a larger diameter. As a result, a fastening force for setting a desired slip generating torque can be set at a value smaller than that obtained, for example, in the case where the torque absorbing mechanism is configured by press-fitting the gear around the kick shaft or counter shaft. In other words, the press-fit amount required in the case where the gear is press-fitted around the boss may be smaller than the press-fit amount required in the case where the gear is press-fitted around the kick shaft or counter shaft. In this way, because of the fact that the fastening force is small in addition to the fact that the press-fit surface is subjected to the low temperature sulphurizing treatment, it is possible to further reduce the wear of the press-fit surface. This makes it possible to obtain the kick-type starter including the rotation transmitting mechanism having the torque absorbing mechanism which is further enhanced in durability. Further, like the first embodiment, since the press-fitting of the boss and the gear to each other can be performed on the basis of elastic deformation of each of the boss and the gear within the elastic limit thereof, it is easy to set the fastening force and thereby the slip generating torque at the press-fitted portions.

Further, it is possible to individually set the slip generating torques for the first and second press-fitted portions in accordance with the strength of the gears, and hence to increase the degree of freedom in design.

A kick-type starter according to a third embodiment has the same configuration as that of the kick-type starter according to the second embodiment except that the idler gear provided on the counter shaft is configured as a gear set composed of a second idler gear having a boss integrally formed on the left portion of the second idler gear and a first idler gear press-fitted around the boss, in place of the gear set composed of the first idler gear 127 having the boss 127*b* integrally formed on the right portion of the first idler gear 127 and the second idler gear 128 press-fitted around the boss 127*b*; and further, like the kick-type starter in the second embodiment, a toothed portion meshed with the toothed portion 118*a* of the pinion gear 118 is formed on the first idler gear and a toothed portion meshed with the toothed portion 131*a* of the auxiliary gear 131 is formed on the second idler gear. The function and the effect of the kick-type starter in the third embodiment are the same as those obtained by the kick-type starter in the second embodiment.

A kick-type starter according to a fourth embodiment of the present invention has the same configuration as that of the kick-type starter according to the third embodiment, except that a gear composed of a boss and a pinion gear which is not separated from but integrated with the boss is provided on the kick shaft 111 in place of the gear set composed of the boss 117 and the pinion gear 118. The function and effect of the kick type starter in the fourth embodiment are the same as those obtained by the kick-type starter in the third embodiment, except for the function and effect obtained by the configuration in which the gear set is composed of the boss and the pinion gear which are not press-fitted to each other.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A starter for an internal combustion engine includes a rotation transmitting mechanism for transmitting the rotation of an input portion to a crank shaft, wherein said rotation transmitting mechanism is provided with a torque absorbing mechanism for absorbing an excessive torque caused by an excessive input from said input portion or a reversed input from said crank shaft, said a torque absorbing mechanism comprising:

a supporting shaft;

a gear set composed of an input gear and an output gear, said input gear and said output gear being press-fitted to each other and being mounted on said supporting shaft; and at least one of a press-fit surface of said input gear and a press-fit surface of said output gear is subjected to a low temperature sulphurizing treatment.

2. The starter for an internal combustion engine according to claim 1, wherein said supporting shaft is a kick shaft.

3. The starter for an internal combustion engine according to claim 1, wherein said supporting shaft is an idler shaft.

4. The starter for an internal combustion engine according to claim 1, wherein one of said input gear and said output gear is press-fitted to a boss of the other of said input gear and said output gear, the other gear being a different member from that of said supporting shaft.

5. The starter for an internal combustion engine according to claim 1, wherein said press-fitting is based on elastic deformation within an elastic limit.

6. The starter for an internal combustion engine according to claim 1, and further including a biasing means operatively disposed relative to said supporting shaft for returning said shaft to an initial position after actuation.

7. The starter for an internal combustion engine according to claim 1, and further including a boss mounted on said supporting shaft, said boss including a ratchet portion and a pinion gear, an outer peripheral surface of said boss being subjected to a low temperature sulphurizing treatment.

8. The starter for an internal combustion engine according to claim 1, and further including a boss mounted on said supporting shaft, said boss including a ratchet portion and a pinion gear, an inner peripheral surface of said pinion gear being subjected to a low temperature sulphurizing treatment.

9. The starter for an internal combustion engine according to claim 7, wherein said low temperature sulphurizing treatment is conducted in an alkali metal salt bath containing sulfur maintained at a temperature in the range of 185° C. to 195° C.

10. The starter for an internal combustion engine according to claim 8, wherein said low temperature sulphurizing treatment is conducted in an alkali metal salt bath containing sulfur maintained at a temperature in the range of 185° C. to 195° C.

11. The starter for an internal combustion engine according to claim 1, wherein said press-fit surface of said input gear is a cylindrical press-fit surface.

12. The starter for an internal combustion engine according to claim 1, wherein said press-fit surface of said output gear is a cylindrical press-fit surface.

13. A method of treating a torque absorbing mechanism for absorbing an excessive torque caused by an excessive input from an input portion or a reversed input from a crank shaft comprising the following steps:

forming a supporting shaft;

masking a portion of a gear set not required to be treated, said gear set including an input gear and an output gear;

dipping said gear set into a bath of alkali metal salt containing sulfur;

connecting a plus electrode to said gear set;

subjecting the solution to anodic electrolysis for a predetermined period of time for providing a low temperature sulphurizing treatment; and positioning said gear set composed of the input gear and the output gear on said supporting shaft, said input gear and said output gear being press-fitted to each other.

14. The method according to claim 13, wherein a diffusion layer of sulfide is formed on the unmasked surface of said gear set.

15. The method according to claim 14, wherein the diffusion layer has a thickness of approximately 7 $\mu$m.

16. The method according to claim 13, wherein the said bath of alkali metal salt is maintained in a temperature range of 185° C. to 195° C.

17. The method according to claim 14, wherein the said bath of alkali metal salt is maintained in a temperature range of 185° C. To 195° C.

18. The method according to claim 15, wherein the said bath of alkali metal salt is maintained in a temperature range of 185° C. to 195° C.

* * * * *